United States Patent [19]

Wood

[11] 3,930,621

[45] Jan. 6, 1976

[54] PAPER HOLDING ATTACHMENT FOR DRAFTING BOARDS

[76] Inventor: Russell J. Wood, Bailey Road, Lanesboro, Mass. 01237

[22] Filed: June 24, 1974

[21] Appl. No.: 482,081

[52] U.S. Cl. ..... 242/67.1 D
[51] Int. Cl.[2] ..... B65H 17/02
[58] Field of Search ..... 242/67.1 D, 67.1 R, 75.2; 269/16

[56] References Cited

UNITED STATES PATENTS

| | | | |
|---|---|---|---|
| 414,067 | 10/1889 | Mohan | 242/67.1 D |
| 1,934,952 | 11/1933 | Shoemaker | 242/67.1 D |
| 2,872,842 | 2/1959 | Grass | 242/71.2 X |
| 3,190,574 | 6/1965 | Purzycki | 242/55 |
| 3,394,900 | 7/1968 | Gross | 242/67.1 R |

*Primary Examiner*—Edward J. McCarthy
*Attorney, Agent, or Firm*—Robert T. Gammons

[57] ABSTRACT

An attachment for a drafting board comprising an elongate cylindrical chamber adapted to be removably attached to an edge of a drafting board, such cylindrical chamber containing a longitudinal opening through which paper may be withdrawn or retracted, a rotor mounted within the chamber for receiving a roll of drafting paper, spring means mounted within the chamber for yieldably pressing the paper against the surface of the rotor, said spring means being adapted to be withdrawn to enable placing the paper within the chamber and a crank for rotating the rotor.

10 Claims, 4 Drawing Figures

PAPER HOLDING ATTACHMENT FOR DRAFTING BOARDS

BACKGROUND OF INVENTION

The drafting board attachment herein disclosed is like, in some respects, the attachment shown in my U.S. Pat. No. 2,627,696 which is designed to hold drafting paper when working upon large layouts such as architectural drawings or machine assembly drawings and wherein it is frequently desirable to move the paper transversely or forwardly and rearwardly on the board to bring different portions of the drawings into a convenient place for making changes and/or additions. The attachment of this invention is provided with an improved construction to enable more easily taking up the paper in coil form within the attachment and to be used in conjunction with a corresponding attachment at the opposite parallel edge of the board to enable transferring the paper from one side to the other or from bottom to top and to hold it substantially tautly in place.

SUMMARY OF INVENTION

As herein illustrated, the paper holder of this invention comprises an elongate hollow housing defining an interior chamber whose interior wall is cylindrically concave for receiving a roll of drafing paper, said housing having an opening lengthwise thereof through which the paper may be slipped into or out of the chamber, means for supporting said housing at an edge of a drafting board below the surface with the opening parallel to the edge and substantially at the level of the surface, said means providing an upwardly inclined apron on which the paper from the opening travels to or from the plane of the board, a rotor mounted in the chamber in concentric relation thereto for rotation about the longitudinal axis of the chamber upon which the paper is adapted to be wound, means supported from the interior concave wall of the chamber for yieldably pressing the paper against the surface of the rotor to cause it to become wound on the rotor as the latter is rotated and means for effecting rotation of the rotor. The means for pressing the paper against the rotor comprise spring members mounted interiorly of the chamber which extend along an arcuate path of decreasing radius of curvature into engagement with the rotor. These spring members are adapted to be withdrawn from the chamber through openings in the wall to clear the interior of the chamber for inserting a roll of paper therein. There are guide members on the outer sides of the chamber through which the spring members are guided and held engaged with the exterior surface of the chamber when withdrawn. The peripheral surface of the rotor has a friction surface to assist in winding of the paper thereon. To attach the housing to the edge of a drafting board there is provided a bracket having a part adapted to be screwed on to the edge of the drafting board and a part adapted to provide an extension to the board the edge of which terminates in a sloping surface which enters the opening to the chamber and provides an apron over which the paper may be withdrawn from the chamber onto the surface of the board and vice versa. One attachment may be used at one edge of the board in which case the paper is drawn across the board and is thumbtacked at the opposite edge, the attachment in this arrangement being provided to take up the paper when it is not desirable to leave it spread out on the board. Usually two such attachments are used, one at each edge or one at the top and one at the bottom, so that the paper may be stretched therebetween and held taut while being worked upon and may be drawn in either direction to enable making changes or additions at various places without having to move from one place to another.

The invention will now be described in greater detail with reference to the accompanying drawings, wherein.

Figure 1:
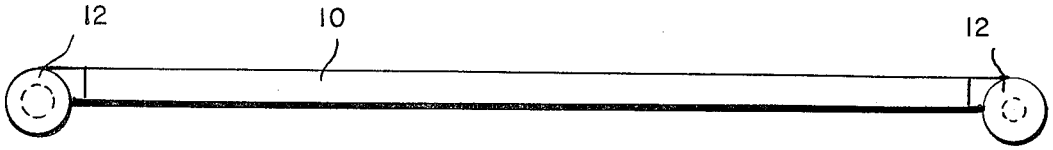
FIG. 1 is an edge view of a drafting board with an attachment at each side.
Figure 2:
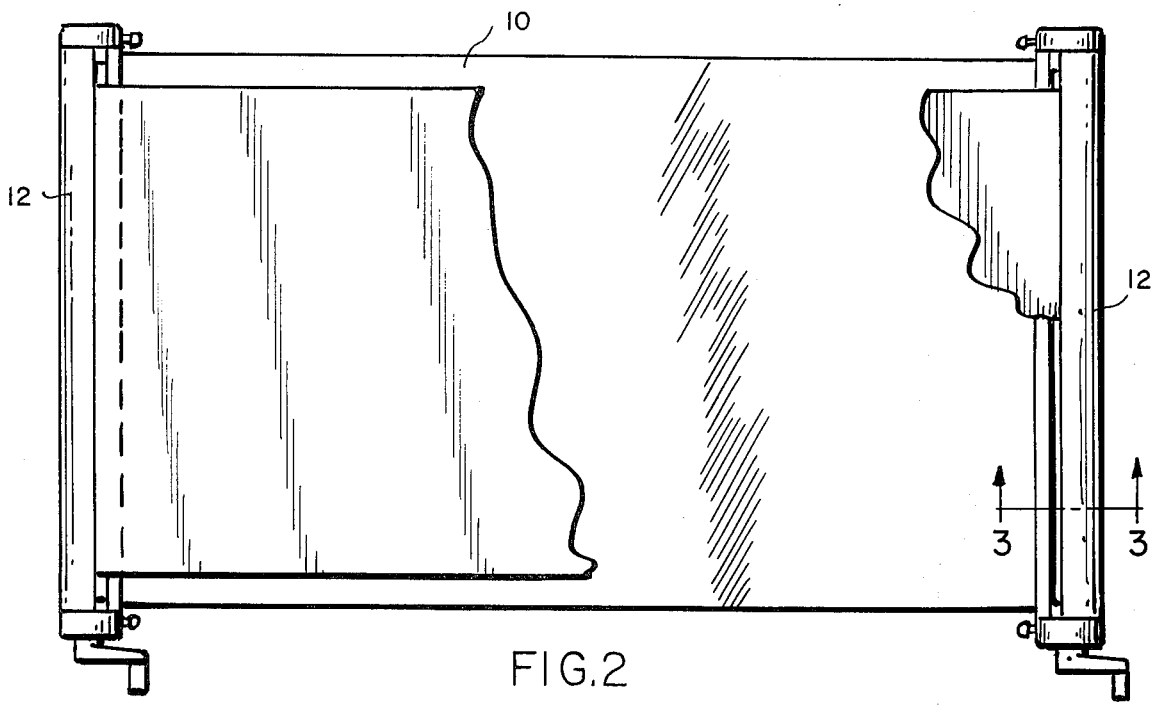
FIG. 2 is a plan view of the drafting board showing an attachment at each end.

Referring to the drawings, there is shown in FIGS. 1 and 2, a drafting board 10 and mounted at its opposite edges paper holding attachments 12—12. While the attachments are shown at the opposite edges or ends of the board in these figures it is within the scope of this invention to mount the attachments at the top and bottom edges of the board. In whichever place of mounting, the attachments are designed to hold a roll of drafting paper in such a way that it may be alternately unwound from one attachment and wound up in the other or unwound from the other attachment and wound up in the one and to be stretched between the attachments tautly across the board while conducting drafting operations. A single attachment may be used at either edge or at the top or bottom to hold a roll of paper in which case the free end of the paper is drawn from the attachment across the board or from top to bottom and thumbtacked at the opposite edge.

Figure 4:
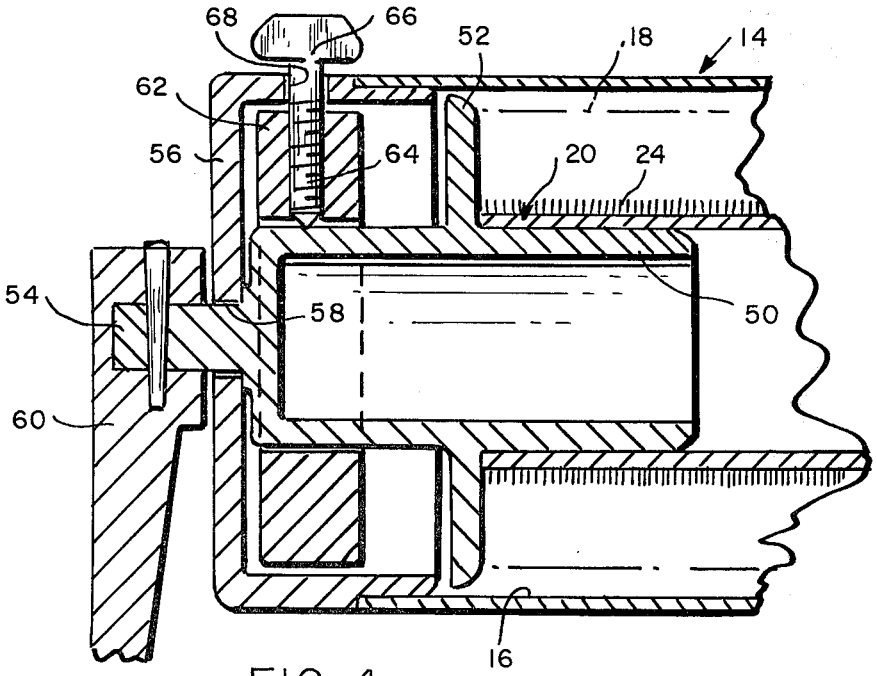
FIG. 4 is a fragmentary section taken on the line 4—4 of Section 3 showing one of the spring fingers in section and the other in elevation.
Figure 3:
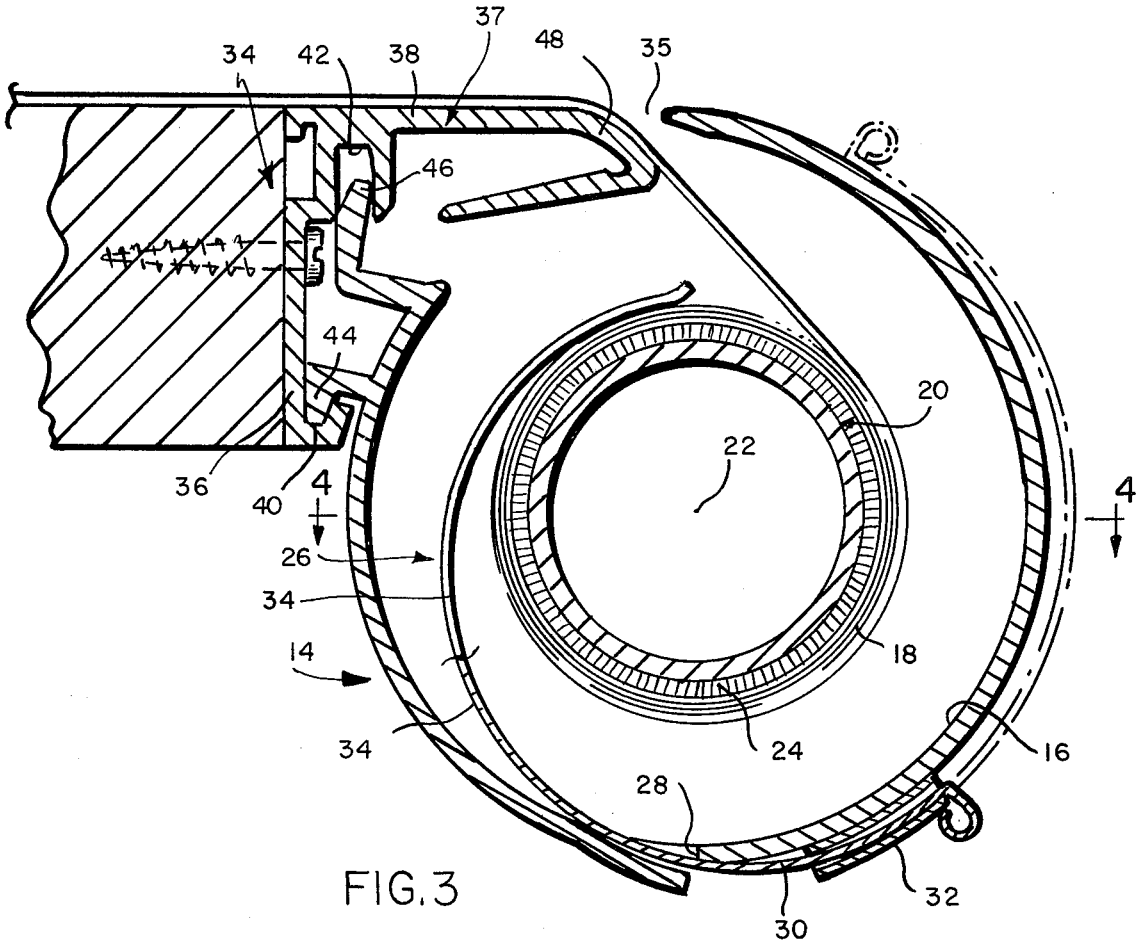
FIG. 3 is a transverse diametrical section taken on the line 3—3 of FIG. 2 to much larger scale.

The attachments are identical for opposite edges or for the top and bottom and so only one will be described herein, that shown at the right hand of the drafting board in FIGS. 1 and 2. Referring to FIGS. 3 and 4, the attachment comprises an elongate hollow cylindrical housing 14 having an inner cylindrical concave wall 16 for receiving a roll of drafting paper 18. A rotor 20 is mounted within the chamber in concentric relation thereto for rotation about an axis 22 on which the paper is supported and wound or unwound as the case may be. To enable winding the paper onto the rotor and to provide for substantial tension in the length of paper stretched across the board, there is provided on the surface of the rotor friction engendering means 24 and for engagement with the rotor spring fingers 26—26 spaced lengthwise of the chamber. The friction engendering means may be, for example, a pile fabric, suede or cork applied to the surface of the rotor which will not damage the surface of the paper. The spring fingers 26—26 are narrow metal strips which are transversely flat and prestressed to coil. The coiled spring fingers are mounted through openings 28—28 in the wall of the chamber with portions 30—30 outside the chamber engaged within guides 32—32 and portions 34—34 inside the chamber which diverge from the inner surface toward the rotor and hence into yielding engagement with the peripheral surface of the rotor. The combined action of the friction engendering surface of the rotor and the pressure applied by the coiled spring fingers 26—26 causes the paper to be wound on the rotor and serves to hold the paper taut at any given position. As illustrated in FIG. 3, the coiled spring fingers 26—26 may be withdrawn as shown in dot-dash lines from the chamber so as to enable placing the roll of paper within the chamber.

A longitudinally extending narrow opening 35 is provided in the wall of the chamber through which the paper is adapted to be withdrawn or retracted and the chamber is detachably attached to the edge of the drafting board so that this opening is parallel to the edge and substantially at the level of the surface of the board.

A bracket 37 is employed to detachably mount the housing and comprises right angularly disposed parts 36 and 38, FIG. 3, which are coextensive with the edge of the board and the axial length of the housing. The part 36 contains openings for receiving screws by means of which it is fastened to the board and has vertically spaced longitudinally extending grooves 40 and 42 for slidably receiving vertically spaced flanges 44 and 46 formed on the outer side of the cylindrical wall. The part 38 provides a horizontal extension of the board which extends part way across the opening 35 and has an inclined surface 48 for guiding the paper smoothly into or out of the chamber.

The rotor 20 is provided at its ends with hub members 50—50, FIG. 4, on which there are radially extending flanges 52—52 for confining the paper on the rotor at its edges. The ends of the hubs 50—50 have sub-shafts 54—54 which extend through caps 56—56 at opposite ends of the housing, the caps being provided with bearing openings 58—58 for rotatably receiving the sub-shafts 54—54. At one end, a crank 60 is secured to a sub-shaft 54 to enable rotating the rotor.

It may be desirable to positively lock the rotor against rotation rather than rely on frictional resistance to rotation and for this purpose there is mounted on the hub 50 at one end a collar 62 containing a threaded opening 64. An opening 68 is provided in the cap 56 at that end and a thumb screw 66 is mounted in the opening 68 and threaded into the threaded opening 64 against the hub. By turning the screw in the collar against the hub, the latter may be prevented from rotating.

The housing as thus described is an exceedingly simple and easily mounted device and provides for quickly and easily traversing the drafting paper on the surface of the drafting board and holding it in a predetermined position.

It should be understood that the present disclosure is for the purpose of illustration only and includes all modifications or improvements which fall within the scope of the appended claims.

I claim:

1. A paper holding attachment for use with drafting boards, comprising an elongate hollow housing defining an interior paper holding chamber whose interior wall is cylindrically concave for receiving a roll of drafting paper, said housing having an opening lengthwise thereof through which the paper may be slipped into or out of the chamber, means for supporting the housing at an edge of the drafting board below the surface with the opening parallel to said edge and substantially at the level of the surface of the board, said means providing an upwardly inclined apron over which the paper from the opening travels to the plane of the board, a rotor mounted in the chamber in concentrical relation thereto for rotation about said axis upon which the paper is adapted to be wound, spring members comprising coils mounted interiorly of the chamber from the concave wall, said spring members extending along arcuate paths of descreasing radius of curvature into engagement with the rotor and said chamber being provided with axially spaced openings in its wall through which the spring members can be withdrawn to positions such that only their distal ends are engaged with the inner side of the wall.

2. A paper holding attachment according to claim 1, wherein there are guides on the convex outer side wall of the housing adjacent the openings through which the spring members are arranged to be withdrawn and with which the spring members are adapted to be frictionally engaged as they are withdrawn to hold the withdrawn portion of the spring members engaged with the convex outer side wall of the housing.

3. A paper holding attachment according to claim 1, wherein there are means at the outer ends of the spring members for manipulating them to withdraw or insert the spring members.

4. A paper holding attachment for use with drafting boards, comprising an elongate hollow housing defining an interior paper holding chamber whose interior wall is cylindrically concave for receiving a roll of drafting paper, said housing having a narrow opening lengthwise thereof through which the paper may be slipped into and out of the chamber, means for supporting the housing at an edge of the drafting board below the surface with the opening parallel to the edge and substantially at the level of the surface, said means providing an upwardly inclined apron along one side of the opening over which the paper from the opening may be moved to or from the plane of the board, a rotor mounted in the chamber in concentric relation thereto for rotation about said longitudinal axis upon which the paper is adapted to be wound, means supported within the chamber which extends part way around the rotor divergently from the wall of the chamber and convergently towards the rotor into engagement therewith for yieldably pressing the paper against the surface of the rotor to cause it to become wound onto the rotor as the latter is rotated, said means extending around the rotor in a direction corresponding to the direction the rotor is rotated to wind the paper onto the rotor and means for effecting rotation of the rotor.

5. A paper holding attachment according to claim 4, wherein the means for supporting the housing at the edge of the drafting board is designed to detachably mount the holder thereon and comprises a bracket having right angularly disposed parts, one of which is adapted to be screwed to the edge face of the board and has an outwardly facing channel and the other of which is designed to form an extension of the board, and flange means extending from the convex outer side wall of the housing adjacent the opening for sliding engagement with the channel to support the housing with said extension adjacent the opening and wherein the extension at its distal edge has a smooth surface inclined downwardly into the opening over which the paper is adapted to be moved as it enters or leaves the opening.

6. A paper holding attachment according to claim 4, wherein the rotor has on its peripheral surface frictional means.

7. A paper holding attachment according to claim 4, wherein there are bearing caps at the opposite ends of the chamber and there are hub members at the opposite ends of the rotor rotatably supported in the bearing caps.

8. A paper holding attachment according to claim 7, wherein the hub members have radial flanges corresponding substantially to the interior diameter of the chamber for confining the edges of the paper wound on the rotor.

9. A paper holding attachment according to claim 7, wherein the hub members have affixed thereto extensions which extend through the bearing caps and there are crank handles mounted on the extension by means of which the rotor can be rotated.

10. A paper holding attachment for use with drafting boards, comprising an elongate hollow housing defining an interior paper holding chamber whose interior wall is cylindrically concave for receiving a roll of drafting paper, said housing having an opening lengthwise thereof through which the paper may be slipped into or out of the chamber, means for supporting the housing at an edge of the drafting board below the surface with the opening parallel to said edge and substantially at the level of the surface, said means providing an upwardly inclined apron on which the paper from the opening travels to the plane of the board, a rotor mounted in the chamber in concentric relation thereto, for rotation about said axis upon which the paper is adapted to be wound, spring members mounted interiorly of the chamber on the concave wall, said spring members being stressed to form coils of a lesser radius of curvature than the interior of the chamber so that they extend along an arcuate path of decreasing radius of curvature with respect to the interior wall of the chamber into engagement with the surface of the rotor for yieldably pressing the paper against the surface of the rotor to cause it to become wound onto the rotor as the latter is rotated, said spring members extending around the rotor in a direction corresponding to the direction the rotor is rotated to wind the paper on the rotor and means for effecting rotation of the rotor.

* * * * *